US008441206B2

(12) United States Patent
Myers et al.

(10) Patent No.: US 8,441,206 B2
(45) **Date of Patent: *May 14, 2013**

(54) LIGHTING DEVICES AND METHODS FOR LIGHTING

(75) Inventors: Peter Jay Myers, Raleigh, NC (US); Michael Harris, Cary, NC (US); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/433,896

(22) Filed: Mar. 29, 2012

(65) Prior Publication Data

US 2012/0187848 A1 Jul. 26, 2012

Related U.S. Application Data

(63) Continuation of application No. 12/117,280, filed on May 8, 2008, now Pat. No. 8,174,205.

(60) Provisional application No. 60/943,910, filed on Jun. 14, 2007, provisional application No. 60/916,596, filed on May 8, 2007, provisional application No. 60/916,607, filed on May 8, 2007, provisional application No. 60/916,590, filed on May 8, 2007, provisional application No. 60/916,608, filed on May 8, 2007, provisional application No. 60/916,597, filed on May 8, 2007, provisional application No. 60/944,848, filed on Jun. 16, 2007.

(51) Int. Cl.
*H05B 37/02* (2006.01)

(52) U.S. Cl.
USPC ..... 315/291; 315/158; 315/307; 315/309

(58) Field of Classification Search ..... 315/149–159, 315/185 R, 291, 294, 297, 307–309, 312
See application file for complete search history.

(56) References Cited

U.S. PATENT DOCUMENTS 4,329,625 A 5/1982 Nishizawa et al.
5,088,817 A 2/1992 Igaki et al.

(Continued)

FOREIGN PATENT DOCUMENTS

CN 1755447 4/2006
CN 1841158 10/2006

(Continued)

OTHER PUBLICATIONS

Deurenberg et al., *Achieving color point stability in RGB multi-chip LED modules using various color control loops*, Proceedings of SPIE, vol. 5941, Sep. 7, 204, pp. 1-12.

(Continued)

*Primary Examiner* — Tung X Le
(74) *Attorney, Agent, or Firm* — Burr & Brown

(57) ABSTRACT

A lighting device comprises groups of solid state light emitters, a sensor and circuitry. If the emitters are illuminated, the sensor is exposed to combined light from the groups, and senses only a portion of the combined light. The circuitry adjusts current applied to at least one of the emitters based on an intensity of the light sensed. Also, a device comprising emitters, a circuit board and a sensor, at least one of the emitters being positioned on the first circuit board and the sensor being spaced from the circuit board. Also, a lighting device comprising emitters, a sensor, and circuitry which adjusts current applied an emitters based on detection by the first sensor, the circuitry comprising a differential amplifier circuit. Also, a lighting device, comprising light emitters and circuitry which adjusts current applied to only some of the emitters based on ambient temperature. Also, methods of lighting.

92 Claims, 2 Drawing Sheets

U.S. PATENT DOCUMENTS

| | | | | |
|---|---|---|---|---|
| 5,783,909 | A | 7/1998 | Hochstein | |
| 6,078,148 | A | 6/2000 | Hochstein | |
| 6,127,784 | A | 10/2000 | Grossman et al. | |
| 6,153,985 | A | 11/2000 | Grossman | |
| 6,236,331 | B1 | 5/2001 | Dussureault | |
| 6,285,139 | B1 | 9/2001 | Ghanem | |
| 6,362,578 | B1 | 3/2002 | Swanson et al. | |
| 6,441,558 | B1 | 8/2002 | Muthu et al. | |
| 6,495,964 | B1 | 12/2002 | Muthu et al. | |
| 6,498,440 | B2 | 12/2002 | Stam et al. | |
| 6,510,995 | B2 | 1/2003 | Muthu et al. | |
| 6,576,881 | B2 | 6/2003 | Muthu et al. | |
| 6,630,801 | B2 | 10/2003 | Schuurmans | |
| 6,674,060 | B2 | 1/2004 | Antila | |
| 6,693,394 | B1 | 2/2004 | Guo et al. | |
| 6,741,351 | B2 | 5/2004 | Marshall et al. | |
| 6,836,081 | B2 | 12/2004 | Swanson et al. | |
| 6,841,947 | B2 | 1/2005 | Berg-johansen | |
| 7,009,343 | B2 | 3/2006 | Lim et al. | |
| 7,135,664 | B2 | 11/2006 | Vornsand et al. | |
| 7,140,752 | B2 | 11/2006 | Ashdown | |
| 7,173,384 | B2 | 2/2007 | Plotz et al. | |
| 7,186,000 | B2 | 3/2007 | Lebens et al. | |
| 7,202,608 | B2 | 4/2007 | Robinson et al. | |
| 7,208,713 | B2 | 4/2007 | Ishiguchi | |
| 7,213,940 | B1 | 5/2007 | Van de Ven et al. | |
| 7,256,557 | B2 | 8/2007 | Lim et al. | |
| 7,948,190 | B2 | 5/2011 | Grajcar | |
| 8,330,393 | B2 * | 12/2012 | Thomson et al. | 315/308 |
| 2002/0047624 | A1 * | 4/2002 | Stam et al. | 315/291 |
| 2002/0190972 | A1 | 12/2002 | Van de Ven | |
| 2003/0095052 | A1 | 5/2003 | Dechape | |
| 2005/0127381 | A1 | 6/2005 | Vitta et al. | |
| 2006/0038511 | A1 | 2/2006 | Tagawa | |
| 2006/0209304 | A1 * | 9/2006 | Simpson et al. | 356/443 |
| 2006/0237636 | A1 | 10/2006 | Lyons et al. | |
| 2006/0245174 | A1 * | 11/2006 | Ashdown et al. | 362/85 |
| 2007/0080923 | A1 | 4/2007 | Enomoto et al. | |
| 2007/0139920 | A1 | 6/2007 | Van de Ven | |
| 2007/0139923 | A1 | 6/2007 | Van De Ven et al. | |
| 2007/0153526 | A1 * | 7/2007 | Lim | 362/294 |
| 2007/0170447 | A1 | 7/2007 | Negley | |
| 2007/0236911 | A1 | 10/2007 | Negley | |
| 2007/0247414 | A1 | 10/2007 | Roberts | |
| 2007/0263393 | A1 | 11/2007 | Van de Ven | |
| 2007/0267983 | A1 | 11/2007 | Van de Ven | |
| 2007/0274063 | A1 | 11/2007 | Negley | |
| 2007/0274080 | A1 | 11/2007 | Negley | |
| 2007/0278503 | A1 | 12/2007 | Van de Ven | |
| 2007/0278934 | A1 | 12/2007 | Van de Ven | |
| 2007/0278974 | A1 | 12/2007 | Van de Ven | |
| 2007/0279903 | A1 | 12/2007 | Negley | |
| 2007/0280624 | A1 | 12/2007 | Negley | |
| 2008/0007497 | A1 | 1/2008 | Pauritsch | |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0089053 | A1 | 4/2008 | Negley | |
| 2008/0093530 | A1 | 4/2008 | Hoelen et al. | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0130285 | A1 | 6/2008 | Negley | |
| 2008/0136313 | A1 | 6/2008 | Van de Ven | |
| 2008/0137347 | A1 | 6/2008 | Trott | |
| 2008/0179602 | A1 | 7/2008 | Negley | |
| 2008/0211416 | A1 | 9/2008 | Negley | |
| 2008/0238340 | A1 | 10/2008 | Leung et al. | |
| 2008/0278928 | A1 | 11/2008 | Van de Ven | |
| 2008/0278940 | A1 | 11/2008 | Van de Ven | |
| 2008/0278950 | A1 | 11/2008 | Pickard | |
| 2008/0278952 | A1 | 11/2008 | Trott | |
| 2008/0304260 | A1 | 12/2008 | Van de Ven | |
| 2008/0304261 | A1 | 12/2008 | Van de Ven | |
| 2008/0304269 | A1 | 12/2008 | Pickard | |
| 2008/0310154 | A1 | 12/2008 | Van de Ven | |
| 2009/0079363 | A1 | 3/2009 | Ghoman et al. | |
| 2009/0108269 | A1 | 4/2009 | Negley | |
| 2009/0160363 | A1 | 6/2009 | Negley | |
| 2009/0184616 | A1 | 7/2009 | Van de Ven | |
| 2009/0184666 | A1 | 7/2009 | Myers | |
| 2010/0259182 | A1 | 10/2010 | Man et al. | |

FOREIGN PATENT DOCUMENTS

| | | |
|---|---|---|
| WO | 2006/033031 | 3/2006 |
| WO | 2006/033031 A2 | 3/2006 |

OTHER PUBLICATIONS

U.S. Appl. No. 60/990,435, filed Nov. 27, 2007.

U.S. Appl. No. 61/108,133, filed Oct. 24, 2008.

U.S. Appl. No. 13/042,668, filed Mar. 8, 2011, Van de Ven et al.

Perduijn, "Light Output Feedback Solution for RGB LED Backlight Applications".

Deurenberg, P. et al., "Achieving color point stability in RGB multi-chip LED modules using various color control loops", Proceedings of the SPIE, XP-002428542, vol. 5941, Sep. 7, 2005, pp. 1-12.

* cited by examiner

LIGHTING DEVICES AND METHODS FOR LIGHTING

CROSS-REFERENCE TO RELATED APPLICATIONS

This application is a continuation of U.S. patent application Ser. No. 12/117,280, filed May 8, 2008 (now U.S. Patent Publication No. 2008/0211416), the entirety of which is incorporated herein by reference as if set forth in its entirety.

This application claims the benefit of U.S. Provisional Patent Application No. 60/943,910, filed Jun. 14, 2007, the entirety of which is incorporated herein by reference.

This application claims the benefit of U.S. Provisional Patent Application No. 60/916,596, filed May 8, 2007, the entirety of which is incorporated herein by reference.

This application claims the benefit of U.S. Provisional Patent Application No. 60/916,607, filed May 8, 2007, the entirety of which is incorporated herein by reference.

This application claims the benefit of U.S. Provisional Patent Application No. 60/916,590, filed May 8, 2007, the entirety of which is incorporated herein by reference.

This application claims the benefit of U.S. Provisional Patent Application No. 60/916,608, filed May 8, 2007, the entirety of which is incorporated herein by reference.

This application claims the benefit of U.S. Provisional Patent Application No. 60/916,597, filed May 8, 2007, the entirety of which is incorporated herein by reference.

This application claims the benefit of U.S. Provisional Patent Application No. 60/944,848, filed Jun. 19, 2007, the entirety of which is incorporated herein by reference.

FIELD OF THE INVENTIVE SUBJECT MATTER

The present inventive subject matter relates to lighting devices and methods for lighting. In some embodiments, the present inventive subject matter relates to lighting devices which include one or more solid state light emitting devices, e.g., light emitting diodes, and methods of lighting which include illuminating one or more solid state light emitting devices.

BACKGROUND

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (1 m/W), and/or duration of service.

A variety of solid state light emitters are well-known. For example, one type of solid state light emitter is a light emitting diode.

Light emitting diodes are semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been addressed or fully met.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which is electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

Color reproduction is typically measured using the Color Rendering Index (CRI Ra). CRI Ra is a modified average of the relative measurement of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways. Driver response time, however, significantly decreases with lower CRI Ra values (for any given brightness, legibility decreases with lower CRI Ra).

Because light that is perceived as white is necessarily a blend of light of two or more colors (or wavelengths), no single light emitting diode junction has been developed that can produce white light efficiently. "White" light emitting diode lamps have been produced which have a light emitting diode pixel/cluster formed of respective red, green and blue light emitting diodes. Other "white" light emitting diode lamps have been produced which include (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

Aspects related to the present inventive subject matter can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of colors.

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

There is an ongoing need for ways to use solid state light emitters, e.g., light emitting diodes, in a wider variety of applications, with greater energy efficiency, with improved color rendering index (CRI), with improved efficacy (1 m/W), low cost, and/or with longer duration of service.

BRIEF SUMMARY OF THE INVENTIVE SUBJECT MATTER

The present inventive subject matter relates to lighting devices which include solid state light emitters which emit light of at least two different visible wavelengths, so as to generate mixed light. In many cases, it is desirable to control the color of the mixed light. There are a variety of factors, however, which can cause the color of the mixed light to vary over time.

For example, many solid state light emitters tend to emit light of decreasing intensity as time passes, and the extent of such decrease in intensity often differs among solid state light emitters which emit light of different wavelength and over time (e.g., the rate of decrease in emission intensity for a solid state light emitter which emits light of a first wavelength often differs from the rate of decrease in emission intensity for a solid state light emitter which emits light of a second wavelength, and the rates of decrease in emission intensity for both types often differs over time).

In addition, the intensity of light emitted from some solid state light emitters varies based on ambient temperature. For example, LEDs which emit red light often have a very strong temperature dependence (e.g., AlInGaP LEDs can reduce in optical output by ~25% when heated up by ~40° C.).

It would be desirable to provide lighting devices and lighting methods which minimize or avoid such variation in the color of the mixed light. The present inventive subject matter provides such lighting devices and lighting methods.

In accordance with a first aspect of the present inventive subject matter, there is provided a lighting device, comprising:

at least first and second groups of solid state light emitters, the first group of solid state light emitters including at least one first group solid state light emitter, the second group of solid state light emitters including at least one second group solid state light emitter;

at least a first sensor, the first sensor being positioned such that if the first group of solid state light emitters and the second group of solid state light emitters are illuminated, the first sensor will be exposed to combined light, the combined light comprising at least a portion of light emitted by the first group of solid state light emitters and at least a portion of light emitted by the second group of solid state light emitters, the first sensor being sensitive to only a portion of the combined light; and circuitry configured to adjust a current applied to at least a first of the second group of solid state light emitters based on an intensity of the portion of the combined light sensed by the first sensor.

In some embodiments according to the first aspect of the present inventive subject matter, the first sensor is sensitive to only some visible wavelengths.

In some embodiments according to the first aspect of the present inventive subject matter, the portion of the combined light, if mixed in the absence of any other light, would have color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

Light which has color coordinates on a 1931 CIE Chromaticity Diagram which define a point within an area enclosed by the first, second, third, fourth and fifth line segments defined in the preceding paragraph is referred to herein as "BSY" light.

In some embodiments according to the first aspect of the present inventive subject matter, the second group of solid state light emitters comprises at least one solid state light emitter which emits light to which the first sensor is not sensitive. In some of such embodiments, the second group of solid state light emitters comprises at least one solid state light emitter which emits light having a dominant wavelength in the range of from about 600 nm to about 630 nm.

In some embodiments according to the first aspect of the present inventive subject matter, the second group of solid state light emitters consists of solid state light emitters which emit light to which the first sensor is not sensitive. In some of such embodiments, the second group of solid state light emitters comprises at least one solid state light emitter which emits light having a dominant wavelength in the range of from about 600 nm to about 630 nm.

In some embodiments according to the first aspect of the present inventive subject matter, the combined light has x, y coordinates on a 1931 CIE Chromaticity Diagram which define a point which is within ten MacAdam ellipses of at least one point on the blackbody locus on a 1931 CIE Chromaticity Diagram.

In some embodiments according to the first aspect of the present inventive subject matter, the lighting device further comprises:

at least a first circuit board, at least one of the first and second groups of solid state light emitters being positioned on the first circuit board, the first sensor being spaced from the circuit board.

In some of such embodiments, the circuit board is a metal core printed circuit board.

In some of such embodiments, the first sensor is mounted on a spacer, the spacer being mounted on the first circuit board.

In some of such embodiments, the first sensor is spaced from a first plane defined by a first surface of the circuit board.

In some of such embodiments, the circuitry further comprises a differential amplifier circuit connected to the first sensor. In some of these embodiments, the circuitry is further configured to adjust a current applied only to the second group of solid state light emitters based on ambient temperature.

In some embodiments according to the first aspect of the present inventive subject matter, the circuitry further comprises a differential amplifier circuit connected to the first sensor.

In some embodiments according to the first aspect of the present inventive subject matter, the circuitry is further configured to adjust a current applied only to the second group of solid state light emitters based on ambient temperature. In some of such embodiments, the second group of solid state light emitters comprises at least one solid state light emitter which emits light having a dominant wavelength in the range of from about 600 nm to about 630 nm.

In accordance with a second aspect of the present inventive subject matter, there is provided a method of lighting, comprising:

illuminating at least first and second groups of solid state light emitters to produce combined light, the first group of solid state light emitters including at least one first group solid state light emitter; the second group of solid state light emitters including at least one second group solid state light emitter;

sensing only a portion of the combined light; and adjusting a current applied to at least a first of the second group of solid state light emitters based on an intensity of the portion of the combined light.

In some embodiments according to the second aspect of the present inventive subject matter, the portion of the combined light, if mixed in the absence of any other light, would have color coordinates on a 1931 CIE Chromaticity Diagram which define a point within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In some embodiments according to the second aspect of the present inventive subject matter, the second group of solid state light emitters comprises at least one solid state light emitter which emits light to which the first sensor is not sensitive. In some of such embodiments, the second group of solid state light emitters comprises at least one solid state light emitter which emits light having a dominant wavelength in the range of from about 600 nm to about 630 nm.

In some embodiments according to the second aspect of the present inventive subject matter, the second group of solid state light emitters consists of solid state light emitters which emit light which emits light to which the first sensor is not sensitive. In some of such embodiments, the second group of solid state light emitters comprises at least one solid state light emitter which emits light having a dominant wavelength in the range of from about 600 nm to about 630 nm.

In some embodiments according to the second aspect of the present inventive subject matter, the combined light has x, y coordinates on a 1931 CIE Chromaticity Diagram which define a point which is within ten MacAdam ellipses of at least one point on the blackbody locus on a 1931 CIE Chromaticity Diagram.

In some embodiments according to the second aspect of the present inventive subject matter, the current applied to at least a first of the second group of solid state light emitters is adjusted also based on ambient temperature. In some of such embodiments, the second group of solid state light emitters comprises at least one solid state light emitter which emits light having a dominant wavelength in the range of from about 600 nm to about 630 nm.

In accordance with a third aspect of the present inventive subject matter, there is provided a lighting device, comprising:

at least first and second groups of solid state light emitters, the first group of solid state light emitters including at least one first group solid state light emitter, the second group of solid state light emitters including at least one second group solid state light emitter;

at least a first circuit board, at least one of the first and second groups of solid state light emitters being positioned on the first circuit board;

at least a first sensor, the first sensor being positioned such that if the first group of solid state light emitters and the second group of solid state light emitters are illuminated, the first sensor will be exposed to at least a portion of light emitted by the first and second groups of solid state light emitters, the first sensor being spaced from the circuit board; and circuitry configured to adjust a current applied to at least one of the first and second groups of solid state light emitters (i.e., at least one of the first group of solid state light emitters and/or at least one of the second group of solid state light emitters) based on an intensity of light detected by the first sensor.

In some embodiments according to the third aspect of the present inventive subject matter, the circuit board is a metal core printed circuit board.

In some embodiments according to the third aspect of the present inventive subject matter, the first sensor is mounted on a spacer, the spacer being mounted on the first circuit board.

In some embodiments according to the third aspect of the present inventive subject matter, the first sensor is spaced from a first plane defined by a first surface of the circuit board.

In some embodiments according to the third aspect of the present inventive subject matter, the circuitry comprises a differential amplifier circuit connected to the first sensor.

In accordance with a fourth aspect of the present inventive subject matter, there is provided a lighting device, comprising:

at least first and second groups of solid state light emitters, the first group of solid state light emitters including at least one first group solid state light emitter, the second group of solid state light emitters including at least one second group solid state light emitter;

at least a first sensor, the first sensor being positioned such that if the first group of solid state light emitters and the second group of solid state light emitters are illuminated, the first sensor will be exposed to at least a portion of light emitted by the first and second groups of solid state light emitters; and circuitry configured to adjust a current applied to at least one of the first and second groups of solid state light emitters based on an intensity of light detected by the first sensor, the circuitry comprising a differential amplifier circuit connected to the first sensor.

In accordance with a fifth aspect of the present inventive subject matter, there is provided a lighting device, comprising:

at least first and second groups of solid state light emitters, the first group of solid state light emitters including at least one first group solid state light emitter, the second group of solid state light emitters including at least one second group solid state light emitter; and circuitry configured to adjust a current applied only to the second group of solid state light emitters based on ambient temperature.

In some embodiments according to the fifth aspect of the present inventive subject matter, the second group of solid state light emitters comprises at least one solid state light emitter which emits light having a dominant wavelength in the range of from about 600 nm to about 630 nm.

In some embodiments according to the fifth aspect of the present inventive subject matter, a mixture of light emitted from the first group of solid state light emitters and light emitted from the second group of solid state light emitters has x, y coordinates on a 1931 CIE Chromaticity Diagram which define a point which is within ten MacAdam ellipses of at least one point on the blackbody locus on a 1931 CIE Chromaticity Diagram.

In accordance with a sixth aspect of the present inventive subject matter, there is provided a method of lighting, comprising:

illuminating at least first and second groups of solid state light emitters, the first group of solid state light emitters including at least one first group solid state light emitter, the second group of solid state light emitters including at least one second group solid state light emitter;

adjusting a current applied only to the second group of solid state light emitters based on ambient temperature.

In some embodiments according to the sixth aspect of the present inventive subject matter, the second group of solid state light emitters comprises at least one solid state light emitter which emits light having a dominant wavelength in the range of from about 600 nm to about 630 nm.

In some embodiments according to the sixth aspect of the present inventive subject matter, a mixture of light emitted from the first group of solid state light emitters and light emitted from the second group of solid state light emitters has x, y coordinates on a 1931 CIE Chromaticity Diagram which define a point which is within ten MacAdam ellipses of at least one point on the blackbody locus on a 1931 CIE Chromaticity Diagram.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
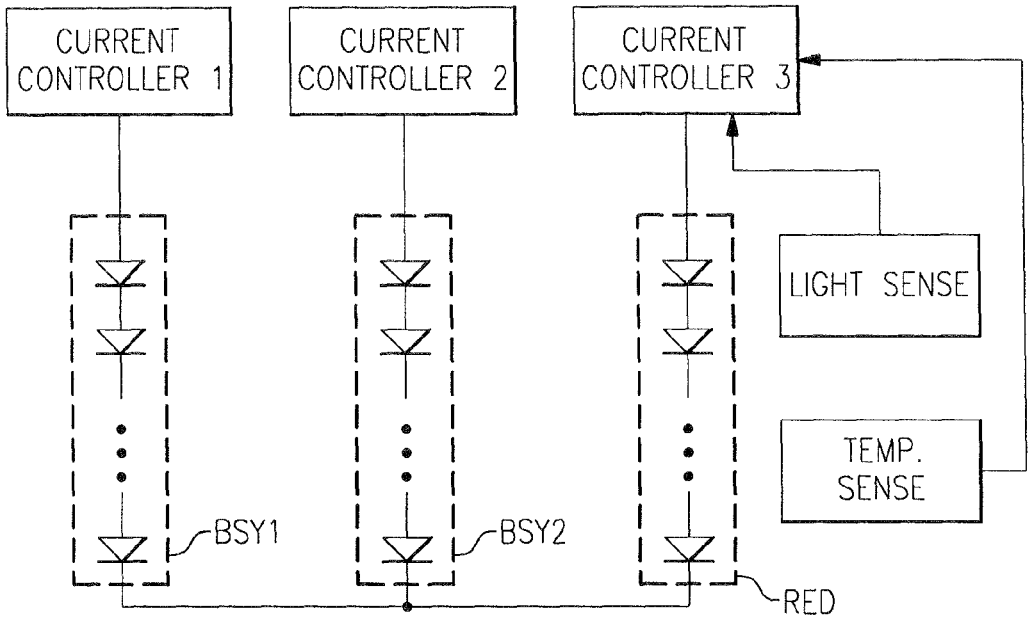
FIGS. 1 and 2 illustrate circuits utilizing a light sensor and a temperature sensor according to certain aspects of the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another element as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "dominant wavelength", is used herein according to its well-known and accepted meaning to refer to the perceived color of a spectrum, i.e., the single wavelength of light which produces a color sensation most similar to the color sensation perceived from viewing light emitted by the light source (i.e., it is roughly akin to "hue"), as opposed to "peak wavelength", which is well-known to refer to the spectral line with the greatest power in the spectral power distribution of the light source. Because the human eye does not perceive all wavelengths equally (it perceives yellow and green better than red and blue), and because the light emitted by many solid state light emitter (e.g., LEDs) is actually a range of wavelengths, the color perceived (i.e., the dominant wavelength) is not necessarily equal to (and often differs from) the wavelength with the highest power (peak wavelength). A truly monochromatic light such as a laser has the same dominant and peak wavelengths.

The solid state light emitters can be saturated or non-saturated. The term "saturated", as used herein, means having a purity of at least 85%, the term "purity" having a well-known meaning to persons skilled in the art, and procedures for calculating purity being well-known to those of skill in the art.

The expression "illumination" (or "illuminated"), as used herein when referring to a solid state light emitter, means that at least some current is being supplied to the solid state light emitter to cause the solid state light emitter to emit at least some electromagnetic radiation with at least a portion of the emitted radiation having a wavelength between 100 nm and 1000 nm. The expression "illuminated" also encompasses situations where the solid state light emitter emits light continuously or intermittently at a rate such that if it is or was visible light, a human eye would perceive it as emitting light continuously, or where a plurality of solid state light emitters of the same color or different colors are emitting light intermittently and/or alternatingly (with or without overlap in "on" times) in such a way that if they were or are visible light, a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in accordance with a first aspect of the present inventive subject matter, there is provided a lighting device comprising at least first and second groups of solid state light emitters, at least a first sensor which is sensitive to only a portion of the light to which it is exposed when the first and second groups are illuminated, and circuitry configured to adjust a current applied to at least a first of the second group of solid state light emitters based on an intensity of the portion of the combined light sensed by the first sensor.

The lighting device may further include one or more devices and/or materials which emit light as a result of the first and second groups of solid state light emitters being illuminated. For example, the lighting device may include luminescent material (e.g., in the form of one or more lumiphor which may, if desired, be packaged together with one or more of the solid state light emitters).

The solid state light emitters (and the luminescent material, e.g., one or more lumiphors, if included) used in the devices and methods according to the present inventive subject matter can be selected from among any solid state light emitters and luminescent materials known to persons of skill in the art. Wide varieties of such solid state light emitters and luminescent materials are readily obtainable and well known to those of skilled in the art, and any of them can be employed in the devices and methods according to the present inventive subject matter. For example, solid state light emitters and luminescent materials which may be used in practicing the present inventive subject matter are described in:

- U.S. Patent Application No. 60/753,138, filed on Dec. 22, 2005, entitled "LIGHTING DEVICE" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;
- U.S. Patent Application No. 60/794,379, filed on Apr. 24, 2006, entitled "SHIFTING SPECTRAL CONTENT IN LEDS BY SPATIALLY SEPARATING LUMIPHOR FILMS" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference;
- U.S. Patent Application No. 60/808,702, filed on May 26, 2006, entitled "LIGHTING DEVICE" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;
- U.S. Patent Application No. 60/808,925, filed on May 26, 2006, entitled "SOLID STATE LIGHT EMITTING DEVICE AND METHOD OF MAKING SAME" (inventors: Gerald H. Negley and Neal Hunter) and U.S. patent application Ser. No. 11/753,103, filed May 24, 2007 (now U.S. Patent Publication No. 2007/0280624), the entireties of which are hereby incorporated by reference;
- U.S. Patent Application No. 60/802,697, filed on May 23, 2006, entitled "LIGHTING DEVICE AND METHOD OF MAKING" (inventor: Gerald H. Negley) and U.S. patent application Ser. No. 11/751,990, filed May 22, 2007 (now U.S. Patent Publication No. 2007/0274063), the entireties of which are hereby incorporated by reference;
- U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;
- U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;
- U.S. Patent Application No. 60/851,230, filed on Oct. 12, 2006, entitled "LIGHTING DEVICE AND METHOD OF MAKING SAME" (inventor: Gerald H. Negley) and U.S. patent application Ser. No. 11/870,679, filed Oct. 11, 2007 (now U.S. Patent Publication No. 2008/0089053), the entireties of which are hereby incorporated by reference;
- U.S. Patent Application No. 60/916,608, filed on May 8, 2007, entitled "LIGHTING DEVICE AND LIGHTING METHOD" (inventors: Antony Paul van de Ven and Gerald H. Negley), the entirety of which is hereby incorporated by reference; and
- U.S. patent application Ser. No. 12/017,676, filed on Jan. 22, 2008 (now U.S. Patent Publication No. 2009/0108269), entitled "ILLUMINATION DEVICE HAVING ONE OR MORE LUMIPHORS, AND METHODS OF FABRICATING SAME" (inventors: Gerald H. Negley and Antony Paul van de Ven), U.S. Patent Application No. 60/982,900, filed on Oct. 26, 2007 (inventors: Gerald H. Negley and Antony Paul van de Ven), the entirety of which is hereby incorporated by reference.

Persons of skill in the art are familiar with sensors which are sensitive to only a portion of visible light, and any of such sensors can be employed in the devices and methods of the present inventive subject matter. For example, the sensor can be a unique and inexpensive sensor (GaP:N LED) that views the entire light flux but is only (optically) sensitive to one or more of a plurality of LED strings. Specifically, the sensor can be sensitive to only the light emitted by LEDs which in combination produce BSY light, and provide feedback to the red LED string for color consistency as the LEDs age (and light output decreases). By using a sensor that only selectively monitors output, the output of one string can be selectively controlled to maintain the proper ratios of outputs and thereby maintain the color temperature of the device. This type of sensor is excited by only light having wavelengths within a particular range, that range excluding red light.

Persons of skill in the art are familiar with, and can readily design and build a variety of types of circuitry which is configured to adjust a current applied to specific solid state light emitters based on an intensity of light sensed by a sensor, and any such circuitry can be employed in the devices and methods of the present inventive subject matter. For example, the circuit can comprise a microprocessor which responds to signals from the sensor to control the current that is supplied to the solid state light emitters being controlled based on the signals from the sensor. The circuit can, if desired, comprise multiple chips. Alternatively, any of a variety of types of circuitry can be employed to respond to signals from the sensor, and persons of skill in the art can design and build such circuits.

In some embodiments according to the present inventive subject matter, there are provided a first group of solid state light emitters which emit light having wavelength in the range of from 430 nm to 480 nm, a second group of solid state light emitters which emit light having wavelength in the range of from 600 nm to 630 nm, a first group of lumiphors which emit light having a dominant wavelength in the range of from about 555 nm to about 585 nm (a combination of light emitted by the first group of solid state light emitters, light emitted by the second group of solid state light emitters and light emitted by the first group of lumiphors being referred to as "combined light"), a sensor which is exposed to the combined light and which is sensitive to the light having wavelength in the range of from 430 nm to 480 nm and the light having wavelength in the range of from 555 nm to about 585 nm but which is not sensitive to the light having wavelength in the range of from 600 nm to 630 nm (i.e., it is sensitive to only a portion of the combined light), and circuitry which is configured to adjust the current applied to the solid state light emitters which emit light having wavelength in the range of from 600 nm to 630 nm (i.e., solid state light emitters to which the sensor is not sensitive) based on the intensity of the combination of light having wavelength in the range of from 430 nm to 480 nm and light having wavelength in the range of from 555 nm to 585 nm (i.e., only a portion of the combined light). In some of such embodiments, each of at least some of the first group of solid state light emitters are packaged together with one or more of the first group of lumiphors. In some of such embodiments, the combined light has x, y coordinates on a 1931 CIE Chromaticity Diagram which define a point which is within ten MacAdam ellipses of at least one point on the blackbody locus on a 1931 CIE Chromaticity Diagram.

As noted above, according to a third aspect of the present inventive subject matter, there is provided a lighting device, comprising at least first and second groups of solid state light emitters, at least a first circuit board, at least a first sensor which is spaced from the circuit board, and circuitry configured to adjust a current applied to at least one of the first and second groups of solid state light emitters based on an intensity of light detected by the sensor.

The descriptions above with respect to solid state light emitters, sensors and circuitry which can be used in connection with the first aspect of the present inventive subject matter is applicable to those components of the second aspect of the present inventive subject matter.

Persons of skill in the art are familiar with a wide variety of circuit boards, and any of such circuit boards can be employed in connection with the present inventive subject matter.

As noted above, in some embodiments according to this aspect of the present inventive subject matter, the circuit board is a metal core printed circuit board. Such circuit boards are very effective for transmitting heat in order to assist in dissipating heat, which can be especially important when using solid state light emitters, as many solid state light emitters do not operate well in high temperatures (in addition to reductions in intensity of light emission, some LEDs' lifetimes can be significantly shortened if they are operated at elevated temperatures—it is generally accepted that the junction temperature of many LEDs should not exceed 70 degrees C. if a long lifetime is desired). Use of such a circuit board, however, can create capacitive coupling between sensor and the circuit board) particularly if the sensor is mounted on or very close to the circuit board), which can result in the circuit board imposing voltage on the sensor signal (i.e., generating "noise" which makes the signal from the sensor less accurate).

In some embodiments according to the present inventive subject matter, the sensor is spaced from a surface of the circuit board by a distance which is sufficient to eliminate such noise, virtually eliminate such noise, or reduce such noise to a tolerable level (capacitance varies as the square of the distance between capacitive "plates", with one "plate" being the circuit board and the other "plate" being, e.g., the leads of the sensor).

As noted above, in some embodiments according to this aspect of the present inventive subject matter, the sensor is spaced from the circuit board by being mounted on a spacer which is mounted on the circuit board. Persons of skill in the art are familiar with a wide variety of materials and shapes for such spacers, and any such spacer can be employed in connection with the present inventive subject matter.

For instance, in a representative embodiment, the circuit board can be an MCPCB LED board. Spacing the sensor off of the MCPCB LED board makes it possible to minimize or eliminate capacitive coupling between sensor and the effects of the MCPCB. During operation, the MCPCB may float at voltages corresponding to the line voltage. Capacitive coupling between the MCPCB and the sensor could otherwise degrade the signal from the sensor and affect performance by imposing the voltage of the MCPCB on the sensor signal. Decoupling the sensor from the MCPCB to reduce the effect of the MCPCB on the sensor, by spacing the sensor from the MCPCB LED board, allows the sensor to operate without substantial interaction with the MCPCB voltage.

As noted above, according to a fourth aspect of the present inventive subject matter, there is provided a lighting device comprising at least first and second groups of solid state light emitters, at least a first sensor, and circuitry configured to adjust a current applied to at least one of the first and second groups of solid state light emitters based on an intensity of light detected by the sensor, the circuitry comprising a differential amplifier circuit connected to the sensor.

Figure 3:
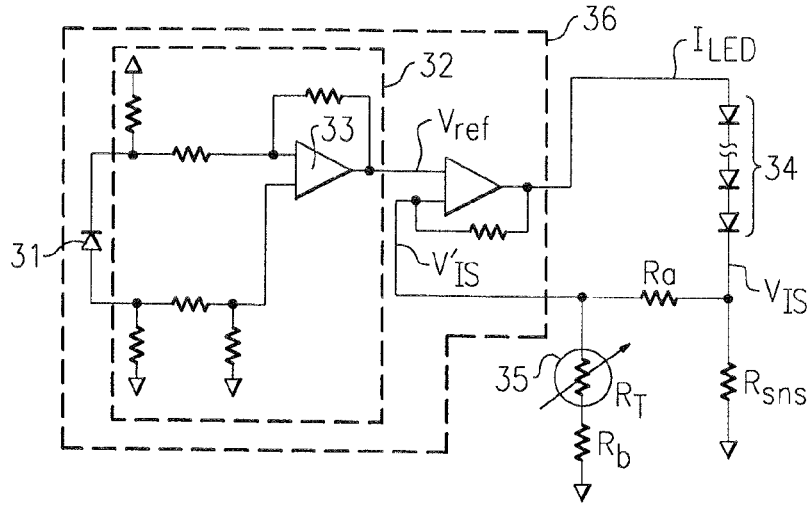
FIGS. 3 and 4 illustrate a circuit which can be employed in the methods and devices of the present inventive subject matter.

Persons skilled in the art are familiar with a variety of differential amplifier circuits, and any of such circuits can be employed in the devices and methods according to the present inventive subject matter. By using a differential amplifier circuit, as will be readily appreciated by persons skilled in the art, voltage is measured across two inputs, rather than with respect to ground. Persons skilled in the art readily understand that the positive wire and the negative wire will pick up the same (or roughly the same) interference, which will cancel out at the comparator. A representative differential amplifier circuit is depicted in FIG. 3, discussed below.

As noted above, according to a fifth aspect of the present inventive subject matter, there is provided a lighting device, comprising at least first and second groups of solid state light emitters, and circuitry configured to adjust a current applied only to the second group of solid state light emitters based on ambient temperature.

Persons of skill in the art are familiar with, and can readily design and build a variety of types of circuitry which is configured to adjust a current applied only to a group (or groups) of solid state light emitters based on ambient temperature, and any such circuitry can be employed in the devices and methods of the present inventive subject matter.

In some embodiments according to the present inventive subject matter, there are provided a first group of solid state light emitters which emit light having wavelength in the range of from 430 nm to 480 nm, a second group of solid state light emitters which emit light having wavelength in the range of from 600 nm to 630 inn, a first group of lumiphors which emit light having a dominant wavelength in the range of from about 555 nm to about 585 nm, and circuitry which is configured to adjust the current applied to the solid state light emitters which emit light having wavelength in the range of from 600 nm to 630 nm based on the ambient temperature. In some of such embodiments, each of at least some of the first group of solid state light emitters are packaged together with one or more of the first group of lumiphors. In some of such embodiments, the combined light has x, y coordinates on a 1931 CIE Chromaticity Diagram which define a point which is within ten MacAdam ellipses of at least one point on the blackbody locus on a 1931 CIE Chromaticity Diagram.

As noted above, some red LEDs have a very strong temperature dependence (e.g., AlInGaP LEDs can reduce in optical output by ~25% when heated up by ~40° C.). Hence, in locations where the fixture/power supply temperatures may vary, this reduced optical output would otherwise affect the color of light output by the lighting device (the ratio of BSY light to red light). This temperature compensation circuit can reduce these changes to a level that is not perceivable (less than delta u'v' of 0.005).

U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;

U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799, filed Apr. 18, 2007 (now U.S. Patent Publication No. 2007/0267983), the entireties of which are hereby incorporated by reference;

U.S. Patent Application No. 60/793,530, filed on Apr. 20, 2006, entitled "LIGHTING DEVICE AND LIGHTING METHOD" (inventors: Gerald H. Negley and Antony Paul van de Ven) and U.S. patent application Ser. No. 11/737,321, filed Apr. 19, 2007 (now U.S. Patent Publication No. 2007/0278503), the entireties of which are hereby incorporated by reference;

U.S. Patent Application No. 60/916,596, filed on May 8, 2007, entitled "LIGHTING DEVICE AND LIGHTING METHOD" (inventors: Antony Paul van de Ven and Gerald H. Negley), the entirety of which is hereby incorporated by reference;

| x | y | u' | v' Warm White | du'v' | time | Box T | Pos T | CCT |
|---|---|---|---|---|---|---|---|---|
| reconfigured 10k-RT-10k | | | | | | | | |
| 0.447 | 0.4161 | 0.251859 | 0.52751 | | 7:24 | 23.3 | 27.5 | 2931 |
| 0.4456 | 0.4105 | 0.253369 | 0.525175 | 0.0028 | 7:34 | 37.2 | 35.5 | 2989 |
| 0.4488 | 0.4119 | 0.254812 | 0.526188 | 0.0032 | 7:46 | 46.4 | 43.6 | 2870 |
| 0.4471 | 0.4117 | 0.253811 | 0.525858 | 0.0026 | 8:02 | 52.2 | 51.7 | 2895 |
| 0.4455 | 0.4119 | 0.252701 | 0.525696 | 0.0020 | 8:21 | 55.7 | 57 | 2921 |
| cool fixture | | | | | | | | |
| 0.4131 | 0.3814 | 0.244778 | 0.508488 | | 9:10 | 22.8 | 24.2 | 3252 |
| 0.4122 | 0.3777 | 0.245796 | 0.506753 | 0.0020 | 9:21 | 34.8 | 32.2 | 3236 |
| 0.4151 | 0.3785 | 0.247385 | 0.507539 | 0.0028 | 9:36 | 41.6 | 41.5 | 3184 |
| 0.4147 | 0.378 | 0.247338 | 0.507262 | 0.0028 | 9:50 | 51.2 | 42.9 | 3187 |
| 0.4139 | 0.3776 | 0.246979 | 0.506967 | 0.0027 | 10:04 | 54.5 | 52.8 | 3199 |
| 0.4132 | 0.3784 | 0.246158 | 0.507208 | 0.0019 | 10:26 | 58.2 | 57.9 | 3221 |

As indicated above, in some embodiments according to the present inventive subject matter, there is provided a circuit which includes both a sensor which senses the output of the solid state light emitters except for the second group, and a sub-circuit which adjusts the current supplied to the second group based on the ambient temperature. With regard to such embodiments, it is not necessary to compensate for the effect of temperature on the solid state light emitter other than the second group.

In general, light of any number of colors can be mixed by the lighting devices according to the present inventive subject matter. Representative examples of blends of light colors are described in:

U.S. Patent Application No. 60/752,555, filed Dec. 21, 2005, entitled "LIGHTING DEVICE AND LIGHTING METHOD" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference;

U.S. Patent Application No. 60/916,607, filed on May 8, 2007, entitled "LIGHTING DEVICE AND LIGHTING METHOD" (inventors: Antony Paul van de Ven and Gerald H. Negley), the entirety of which is hereby incorporated by reference;

U.S. Patent Application No. 60/916,590, filed on May 8, 2007, entitled "LIGHTING DEVICE AND LIGHTING METHOD" (inventors: Antony Paul van de Ven and Gerald H. Negley), the entirety of which is hereby incorporated by reference;

U.S. Pat. No. 7,213,940, issued on May 8, 2007, entitled "LIGHTING DEVICE AND LIGHTING METHOD" (inventors: Antony Paul van de Yen and Gerald H. Negley), the entirety of which is hereby incorporated by reference;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

U.S. patent application Ser. No. 11/948,021, filed on Nov. 30, 2007 (now U.S. Patent Publication No. 2008/0130285), entitled "LIGHTING DEVICE AND LIGHTING METHOD" (inventors: Antony Paul van de Ven and Gerald H. Negley), the entirety of which is hereby incorporated by reference;

U.S. Patent Application No. 60/978,880, filed on Oct. 10, 2007, entitled "LIGHTING DEVICE AND METHOD OF MAKING" (inventors: Antony Paul van de Ven and Gerald H. Negley) and U.S. Patent Application No. 61/037,365, filed on Mar. 18, 2008, the entireties of which are hereby incorporated by reference;

U.S. Patent Application No. 60/868,986, filed on Dec. 7, 2006, entitled "LIGHTING DEVICE AND LIGHTING METHOD" (inventors: Antony Paul van de Ven and Gerald H. Negley), and U.S. patent application Ser. No. 11/951,626, filed Dec. 6, 2007 (now U.S. Patent Publication No. 2008/0136313), the entireties of which are hereby incorporated by reference;

U.S. Patent Application No. 60/916,608, filed on May 8, 2007, entitled "LIGHTING DEVICE AND LIGHTING METHOD" (inventors: Antony Paul van de Ven and Gerald H. Negley), the entirety of which is hereby incorporated by reference; and U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference.

The sources of visible light in the lighting devices of the present inventive subject matter can be arranged, mounted and supplied with electricity in any desired manner, and can be mounted on any desired housing or fixture. Representative examples of suitable arrangements are described in:

U.S. patent application Ser. No. 12/017,558, filed on Jan. 22, 2008 (now U.S. Patent Publication No. 2008/0179602), entitled "FAULT TOLERANT LIGHT EMITTERS, SYSTEMS INCORPORATING FAULT TOLERANT LIGHT EMITTERS AND METHODS OF FABRICATING FAULT TOLERANT LIGHT EMITTERS" (inventors: Gerald H. Negley and Antony Paul van de Ven), U.S. Patent Application No. 60/885,937, filed on Jan. 22, 2007, entitled "HIGH VOLTAGE SOLID STATE LIGHT EMITTER" (inventor: Gerald H. Negley), U.S. Patent Application No. 60/982,892, filed on Oct. 26, 2007, entitled "FAULT TOLERANT LIGHT EMITTERS, SYSTEMS INCORPORATING FAULT TOLERANT LIGHT EMITTERS AND METHODS OF FABRICATING FAULT TOLERANT LIGHT EMITTERS" (inventors: Gerald H. Negley and Antony Paul van de Ven), and U.S. Patent Application No. 60/986,662, filed on Nov. 9, 2007, the entireties of which are hereby incorporated by reference;

U.S. patent application Ser. No. 12/017,600, filed on Jan. 22, 2008 (now U.S. Patent Publication No. 2008/0211416), entitled "ILLUMINATION DEVICES USING EXTERNALLY INTERCONNECTED ARRAYS OF LIGHT EMITTING DEVICES, AND METHODS OF FABRICATING SAME" (inventors: Gerald H. Negley and Antony Paul van de Ven), U.S. Patent Application No. 60/982,909, filed on Oct. 26, 2007 (inventors: Gerald H. Negley and Antony Paul van de Ven) and U.S. Patent Application No. 60/986,795, filed Nov. 9, 2007), the entireties of which are hereby incorporated by reference; and U.S. patent application Ser. No. 12/017,676, filed on Jan. 22, 2008 (now U.S. Patent Publication No. 2009/0108269), entitled "ILLUMINATION DEVICE HAVING ONE OR MORE LUMIPHORS, AND METHODS OF FABRICATING SAME" (inventors: Gerald H. Negley and Antony Paul van de Ven), U.S. Patent Application No. 60/982,900, filed on Oct. 26, 2007 (inventors: Gerald H. Negley and Antony Paul van de Ven), the entirety of which is hereby incorporated by reference.

In addition, persons of skill in the art are familiar with a wide variety of mounting structures for many different types of lighting, and any such structures can be used according to the present inventive subject matter.

For example, fixtures, other mounting structures and complete lighting assemblies which may be used in practicing the present inventive subject matter are described in:

U.S. Patent Application No. 60/752,753, filed on Dec. 21, 2005, entitled "LIGHTING DEVICE" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

U.S. Patent Application No. 60/798,446, filed on May 5, 2006, entitled "LIGHTING DEVICE" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007 (now U.S. Patent Publication No. 2007/0279903), the entireties of which are hereby incorporated by reference;

U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421, filed Sep. 17, 2007 (now U.S. Patent Publication No. 2008/0084700), the entireties of which are hereby incorporated by reference;

U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference;

U.S. Patent Application No. 60/858,558, filed on Nov. 13, 2006, entitled "LIGHTING DEVICE, ILLUMINATED ENCLOSURE AND LIGHTING METHODS" (inventor: Gerald H. Negley) and U.S. patent application Ser. No. 11/939,047, filed Nov. 13, 2007 (now U.S. Patent Publication No. 2008/0112183), the entireties of which are hereby incorporated by reference;

U.S. Patent Application No. 60/858,881, filed on Nov. 14, 2006, entitled "LIGHT ENGINE ASSEMBLIES" (inventors: Paul Kenneth Pickard and Gary David Trott) and U.S. patent application Ser. No. 11/939,052, filed Nov. 13, 2007 (now U.S. Patent Publication No. 2008/0112168), the entireties of which are hereby incorporated by reference;

U.S. Patent Application No. 60/859,013, filed on Nov. 14, 2006, entitled "LIGHTING ASSEMBLIES AND COM- PONENTS FOR LIGHTING ASSEMBLIES" (inventors: Gary David Trott and Paul Kenneth Pickard) and U.S. patent application Ser. No. 11/939,059, filed Nov. 13, 2007 (now U.S. Patent Publication No. 2008/0112170), the entireties of which are hereby incorporated by reference;

U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard) and U.S. patent application Ser. No. 11/877,038, filed Oct. 23, 2007 (now U.S. Patent Publication No. 2008/0106907), the entireties of which are hereby incorporated by reference;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference;

U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams), and U.S. patent application Ser. No. 11/948,041, filed Nov. 30, 2007 (now U.S. Patent Publication No. 2008/0137347) (inventors: Gary David Trott, Paul Kenneth Pickard and Ed Adams), the entireties of which are hereby incorporated by reference;

U.S. Patent Application No. 60/916,030, filed on May 4, 2007, entitled "LIGHTING FIXTURE" (inventors: "Paul Kenneth Pickard, James Michael LAY and Gary David Trott), the entirety of which is hereby incorporated by reference;

U.S. Patent Application No. 60/916,407, filed on May 7, 2007, entitled "LIGHT FIXTURES AND LIGHTING DEVICES" (inventors: Gary David Trott and Paul Kenneth Pickard), the entirety of which is hereby incorporated by reference; and U.S. Patent Application No. 61/029,068, filed on Feb. 15, 2008, entitled "LIGHT FIXTURES AND LIGHTING DEVICES" (inventors: Paul Kenneth Pickard and Gary David Trott), and U.S. Patent Application No. 61/037,366, filed on Mar. 18, 2008 the entireties of which are hereby incorporated by reference.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

With regard to any mixed light described herein in terms of its proximity (e.g., in MacAdam ellipses) to the blackbody locus on a 1931 CIE Chromaticity Diagram and/or on a 1976 CIE Chromaticity Diagram, the present inventive subject matter is further directed to such mixed light in the proximity of light on the blackbody locus having color temperature of 2700 K, 3000 K or 3500 K, namely:

mixed light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4578, 0.4101, the second point having x, y coordinates of 0.4813, 0.4319, the third point having x, y coordinates of 0.4562, 0.4260, the fourth point having x, y coordinates of 0.4373, 0.3893, and the fifth point having x, y coordinates of 0.4593, 0.3944 (i.e., proximate to 2700 K); or mixed light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4338, 0.4030, the second point having x, y coordinates of 0.4562, 0.4260, the third point having x, y coordinates of 0.4299, 0.4165, the fourth point having x, y coordinates of 0.4147, 0.3814, and the fifth point having x, y coordinates of 0.4373, 0.3893 (i.e., proximate to 3000 K); or mixed light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4073, 0.3930, the second point having x, y coordinates of 0.4299, 0.4165, the third point having x, y coordinates of 0.3996, 0.4015, the fourth point having x, y coordinates of 0.3889, 0.3690, and the fifth point having x, y coordinates of 0.4147, 0.3814 (i.e., proximate to 3500 K).

Figure 2:
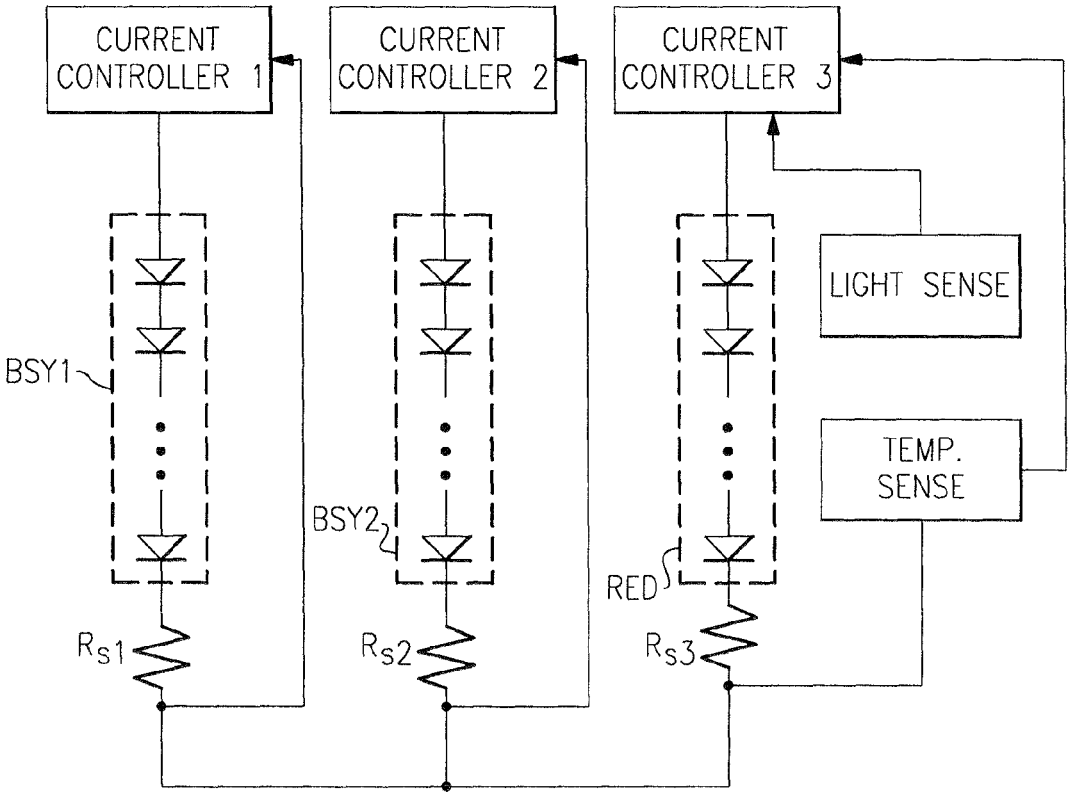

FIGS. 1 and 2 illustrate circuits utilizing a light sensor and a temperature sensor according to certain aspects of the present inventive subject matter. FIGS. 1 and 2 illustrate three strings of LEDs, however, any number of strings of LEDs may be utilized. In particular embodiments, two or more strings are utilized.

FIGS. 1 and 2 also illustrate current control for the various LED strings. Sensor techniques according to the present inventive subject matter may be utilized with any suitable power supply/current control system. For example, sensor techniques according to the present inventive subject matter may be used with AC or DC power supplies. Similarly, sensor techniques according to the present inventive subject matter may be utilized with any power supply topology, such as buck, boost, buck/boost, flyback, etc.

Furthermore any number of current control techniques, such as linear current control or pulse width modulated current control, may be utilized. Such current control may be accomplished with analog circuitry, digital circuitry or combinations of analog or digital circuitry. Techniques for controlling current through LEDs are well known to those of skill in the art and, therefore, need not be described in detail herein. Furthermore, those of skill in the art will understand how the sensors described herein may be incorporated into the various control techniques to control the LED output.

Additionally, while embodiments of the present inventive subject matter are described primarily with reference to the control of current through the LEDs, such sensor techniques could also be utilized in voltage control systems or systems incorporating both current and voltage control.

Accordingly, in light of the above discussion, the current controllers illustrated in FIGS. 1 and 2 are representations of any number of power supply designs that may be utilized with the light and/or temperature sensor according to the present inventive subject matter.

Figure 4:
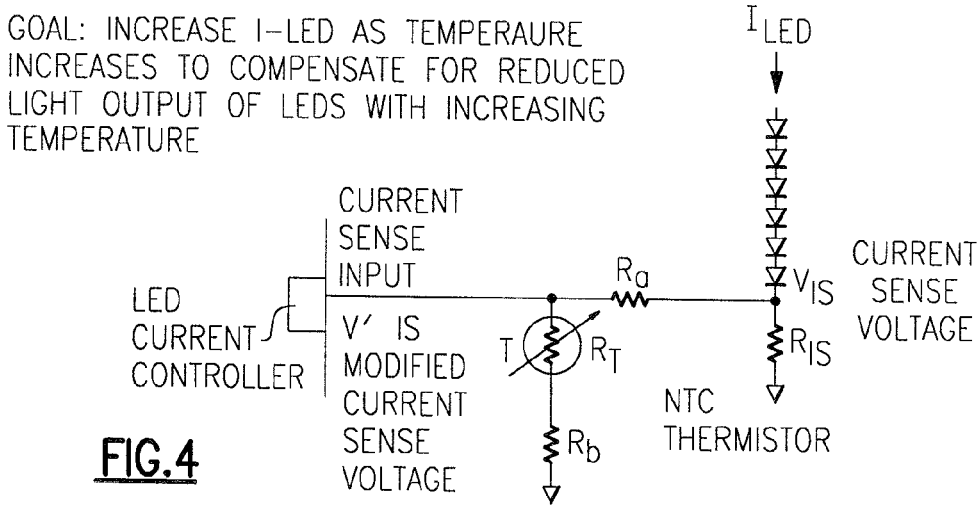

FIG. 3 is a diagram of a circuit which can be employed in the methods and devices of the present inventive subject matter. The circuit shown in FIG. 3 includes a sensor 31, a differential amplifier circuit 32 (which includes a comparator 33), a plurality of red LEDs 34 and a thermistor 35. Features of this circuit include:

- This circuit increases the LED current with increasing temperature by altering the LED sense signal as seen by the controlling element.
- In normal operation, the controller 36 will maintain constant current by adjusting the LED current to maintain a constant voltage as seen at the current sense input (see FIG. 4). A) if $I_{LED}$ increases, $V'_{IS}$ increases, and the controller 36 will reduce current in response. B) If $I_{LED}$ decreases, $V'_{IS}$ decreases, and the controller 36 will increase current in response.
- A voltage divider circuit consisting of $R_a$, $R_b$ and $R_T$ modifies the signal to the current sense input.
  - a) $V'_{IS}=V_{IS}\times(R_T+R_b)/(R_a+R_b+R_T)$
  - b) As the temperature at $R_T$ increases, voltage $V'_{IS}$ decreases, and the controller 36 will increase $I_{LED}$ in response.
  - c) As the temperature at $R_T$ decreases, voltage $V'_{IS}$ increases, and the controller 36 decreases $I_{LED}$ in response.

In some embodiments of the present inventive subject matter, a set of parallel (the arrangement of strings are being referred to here as being "parallel", even though different voltages and currents can be applied to the respective strings) solid state light emitter strings (i.e., two or more strings of solid state light emitters arranged in parallel with each other) is arranged in series with a power line, such that current is supplied through a power line and is ultimately supplied (e.g., directly or after going through a power supply) to each of the respective strings of solid state light emitters. The expression "string", as used herein, means that at least two solid state light emitters are electrically connected in series. In some such embodiments, the relative quantities of solid state light emitters in the respective strings differ from one string to the next, e.g., a first string contains a first percentage of solid state light emitters which emit light having wavelength in a first range and excite luminescent material which emits light having wavelength in a second range (with the remainder being solid state light emitters which emit light having wavelength in a third range) and a second string contains a second percentage (different from the first percentage) of such solid state light emitters. By doing so, it is possible to easily adjust the relative intensities of the light of the respective wavelengths, and thereby effectively navigate within the CIE Diagram and/or compensate for other changes and/or adjust color temperature. Representative examples of such string arrangements are described in:

- U.S. Patent Application No. 60/916,596, filed on May 8, 2007, entitled "LIGHTING DEVICE AND LIGHTING METHOD" (inventors: Antony Paul van de Ven and Gerald H. Negley), the entirety of which is hereby incorporated by reference;
- U.S. Patent Application No. 60/916,607, filed on May 8, 2007, entitled "LIGHTING DEVICE AND LIGHTING METHOD" (inventors: Antony Paul van de Ven and Gerald H. Negley), the entirety of which is hereby incorporated by reference;
- U.S. Patent Application No. 60/916,590, filed on May 8, 2007, entitled "LIGHTING DEVICE AND LIGHTING METHOD" (inventors: Antony Paul van de Ven and Gerald H. Negley), the entirety of which is hereby incorporated by reference;
- U.S. Patent Application No. 60/916,608, filed on May 8, 2007, entitled "LIGHTING DEVICE AND LIGHTING METHOD" (inventors: Antony Paul van de Ven and Gerald H. Negley), the entirety of which is hereby incorporated by reference; and
- U.S. Patent Application No. 60/916,597, filed on May 8, 2007, entitled "LIGHTING DEVICE AND LIGHTING METHOD" (inventors: Antony Paul van de Ven and Gerald H. Negley) and U.S. Patent Application No. 60/944,848, filed Jun. 19, 2007, the entireties of which are hereby incorporated by reference.

Figure 5:
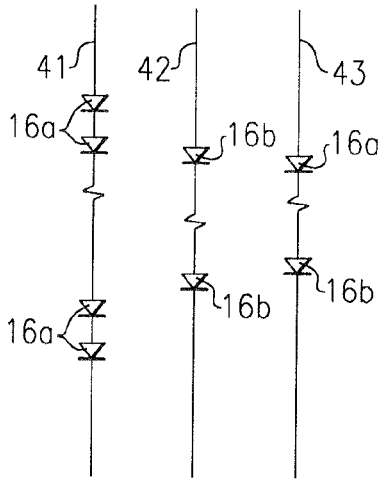
FIG. 5 is a schematic electrical diagram of a portion of circuitry depicting a plurality of strings.

FIG. 5 is a schematic electrical diagram of a portion of circuitry depicting a plurality of strings. As shown in FIG. 5, the lighting device includes a first string 41 of LEDs 16*a*, a second string 42 of LEDs 16*b* and a third string 43 including a mixture of LEDs 16*a* and LEDs 16*b*, the strings being arranged in parallel with one another.

Any two or more structural parts of the lighting devices described herein can be integrated. Any structural part of the lighting devices described herein can be provided in two or more parts (which are held together, if necessary). Similarly, any two or more functions can be conducted simultaneously, and/or any function can be conducted in a series of steps.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A device, comprising:

circuitry configured to adjust a current and/or a voltage of electricity signal supplied to at least a first solid state light emitter of a second group of solid state emitters based on a signal representing an intensity of a portion of combined light comprising at least a portion of light emitted by a first group of solid state light emitters and at least a portion of light emitted by said second group of solid state light emitters.

2. A device as recited in claim 1, wherein the circuitry is configured to adjust current and/or a voltage of electricity signal supplied to at least a first solid state light emitter of a second group of solid state emitters based on a signal representing an intensity of only light emitted from the first group of solid state light emitters.

3. A device as recited in claim 1, wherein:

the device further comprises at least first and second groups of solid state light emitters, said first group of solid state light emitters comprising at least one solid state light emitter, said second group of solid state light emitters comprising at least one solid state light emitter, the device further comprises at least a first sensor positioned such that when said first group of solid state light emitters and said second group of solid state light emitters are illuminated, said first sensor is exposed to combined light comprising at least a portion of light emitted by said first group of solid state light emitters and at least a portion of light emitted by said second group of solid state light emitters, the device further comprises at least first and second electrical conductors configured to apply signals for at least said first and second groups of solid state light emitters; and said circuitry is configured to adjust a current and/or a voltage of electricity signal supplied to at least said first electrical conductor for application to at least one of said second group of solid state emitters.

4. A device as recited in claim 3, wherein:

the first group of solid state light emitters emits light of a first hue, the second group of solid state light emitters emits light of a second hue, and the first hue differs from the second hue.

5. A device as recited in claim 3, wherein the first sensor is sensitive to only a portion of said combined light.

6. A device as recited in claim 3, wherein said second group of solid state light emitters comprises at least one solid state light emitter which emits light having a dominant wavelength in the range of from about 600 nm to about 630 nm.

7. A device as recited in claim 3, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

8. A device as recited in claim 3, wherein said combined light comprises at least a portion of light emitted by a first group of solid state light emitters and at least a portion of light emitted by a second group of solid state light emitters, and said portion of said combined light comprises light emitted by said first group of solid state light emitters.

9. A device as recited in claim 8, wherein said portion of said combined light consists essentially of light emitted by said first group of solid state light emitters.

10. A device as recited in claim 8, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

11. A device as recited in claim 3, wherein said combined light comprises at least a portion of light emitted by a first group of solid state light emitters and at least a portion of light emitted by a second group of solid state light emitters, and said portion of said combined light comprises light emitted by said second group of solid state light emitters.

12. A device as recited in claim 11, wherein said portion of said combined light consists essentially of light emitted by said second group of solid state light emitters.

13. A device as recited in claim 11, wherein said second group of solid state light emitters comprises at least one solid state light emitter which emits light having a dominant wavelength in the range of from about 600 nm to about 630 nm.

14. A device as recited in claim 3, wherein the first sensor is sensitive to only at least a portion of light emitted by said first group of solid state light emitters.

15. A device as recited in claim 14, wherein said second group of solid state light emitters comprises at least one solid state light emitter which emits light having a dominant wavelength in the range of from about 600 nm to about 630 nm.

16. A device as recited in claim 3, wherein the first sensor is sensitive to only at least a portion of light emitted by said second group of solid state light emitters.

17. A device as recited in claim 16, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

18. A device as recited in claim 3, wherein the circuitry is configured to adjust current and/or a voltage of electricity signal supplied to at least a first solid state light emitter of said second group of solid state emitters based on a signal representing an intensity of only light emitted from the first group of solid state light emitters.

19. A device as recited in claim 3, wherein said combined light has x, y coordinates on a 1931 CIE Chromaticity Diagram which define a point which is within ten MacAdam ellipses of at least one point on the blackbody locus on a 1931 CIE Chromaticity Diagram.

20. A device as recited in claim 3, wherein said device further comprises at least a first circuit board, at least one solid state light emitter of said first and second groups of solid state light emitters on said first circuit board, said first sensor spaced from said circuit board.

21. A device as recited in claim 3, wherein said circuitry further comprises a differential amplifier circuit connected to said first sensor.

22. A device as recited in claim 3, wherein said circuitry is further configured to adjust a current and/or a voltage of electricity signal supplied only to said second group of solid state light emitters based on ambient temperature.

23. A device, comprising:

circuitry configured to adjust only a current and/or a voltage of electricity signal supplied to at least a first solid state light emitter of a second group of solid state emitters based on a signal representing an intensity of light sensed by at least a first sensor positioned such that when a first group of solid state light emitters comprising at least a second solid state light emitter and said second group of solid state light emitters are illuminated, said first sensor is exposed to combined light comprising at least a portion of light emitted by said first group of solid state light emitters and at least a portion of light emitted by said second group of solid state light emitters.

24. A device as recited in claim 23, wherein the circuitry is configured to adjust current and/or a voltage of electricity signal supplied to at least a first solid state light emitter of a second group of solid state emitters based on a signal representing an intensity of only light emitted from the first group of solid state light emitters.

25. A device as recited in claim 23, wherein:

the device further comprises at least first and second groups of solid state light emitters, said first group of solid state light emitters comprising at least one solid state light emitter, said second group of solid state light emitters comprising at least one solid state light emitter, the device further comprises at least a first sensor positioned such that when said first group of solid state light emitters and said second group of solid state light emitters are illuminated, said first sensor is exposed to combined light comprising at least a portion of light emitted by said first group of solid state light emitters and at least a portion of light emitted by said second group of solid state light emitters, the device further comprises at least first and second electrical conductors configured to apply signals for at least said first and second groups of solid state light emitters; and said circuitry is configured to adjust a current and/or a voltage of electricity signal supplied to at least said first electrical conductor for application to at least one of said second group of solid state emitters.

26. A device as recited in claim 25, wherein:

the first group of solid state light emitters emits light of a first hue, the second group of solid state light emitters emits light of a second hue, and the first hue differs from the second hue.

27. A device as recited in claim 25, wherein the first sensor is sensitive to only a portion of said combined light.

28. A device as recited in claim 25, wherein said second group of solid state light emitters comprises at least one solid state light emitter which emits light having a dominant wavelength in the range of from about 600 nm to about 630 nm.

29. A device as recited in claim 25, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

30. A device as recited in claim 25, wherein the first sensor is sensitive to only at least a portion of light emitted by said first group of solid state light emitters.

31. A device as recited in claim 30, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

32. A device as recited in claim 25, wherein the first sensor is sensitive to only at least a portion of light emitted by said second group of solid state light emitters.

33. A device as recited in claim 32, wherein said second group of solid state light emitters comprises at least one solid state light emitter which emits light having a dominant wavelength in the range of from about 600 nm to about 630 nm.

34. A device as recited in claim 25, wherein the circuitry is configured to adjust current and/or a voltage of electricity signal supplied to at least a first solid state light emitter of said second group of solid state emitters based on a signal representing an intensity of only light emitted from the first group of solid state light emitters.

35. A device as recited in claim 25, wherein said combined light has x, y coordinates on a 1931 CIE Chromaticity Diagram which define a point which is within ten MacAdam ellipses of at least one point on the blackbody locus on a 1931 CIE Chromaticity Diagram.

36. A device as recited in claim 25, wherein said device further comprises at least a first circuit board, at least one solid state light emitter of said first and second groups of solid state light emitters on said first circuit board, said first sensor spaced from said circuit board.

37. A device as recited in claim 25, wherein said circuitry further comprises a differential amplifier circuit connected to said first sensor.

38. A device as recited in claim 25, wherein said circuitry is further configured to adjust a current and/or a voltage of electricity signal supplied only to said second group of solid state light emitters based on ambient temperature.

39. A method, comprising:

adjusting a current and/or a voltage of electricity signal for supplying to at least a first solid state light emitter of a second group of solid state emitters, based on a signal that represents an intensity of a portion of combined light comprising at least a portion of light emitted by a first group of solid state light emitters and at least a portion of light emitted by a second group of solid state light emitters.

40. A method as recited in claim 39, wherein said signal that represents an intensity of a portion of combined light represents only at least a portion of light emitted by said first group of solid state light emitters.

41. A method as recited in claim 39, wherein said adjusting a current and/or a voltage of electricity signal for supplying to at least a first solid state light emitter of a second group of solid state emitters is also based on ambient temperature.

42. A method, comprising:

adjusting only a current and/or a voltage of electricity signal for supplying to at least a first solid state light emitter of a second group of solid state emitters based on a signal that represents an intensity of light sensed by at least a first sensor positioned such that when a first group of solid state light emitters comprising at least a second solid state light emitter and said second group of solid state light emitters are illuminated, said first sensor is exposed to combined light, said combined light comprising at least a portion of light emitted by said first group of solid state light emitters and at least a portion of light emitted by said second group of solid state light emitters.

43. A method as recited in claim 42, wherein said signal that represents an intensity of a portion of light sensed by at least a first sensor represents only at least a portion of light emitted by said first group of solid state light emitters.

44. A method as recited in claim 42, wherein said adjusting a current and/or a voltage of electricity signal for supplying to at least a first solid state light emitter of a second group of solid state emitters is also based on ambient temperature.

45. A device, comprising:

circuitry configured to adjust only a current and/or a voltage of electricity supplied to a first electrical conductor based on an intensity of light sensed by at least a first sensor; and at least two solid state light emitters, wherein said at least two solid state light emitters comprise at least two solid state light emitters that emit light having a dominant wavelength range, and wherein said first sensor senses light having a wavelength outside said dominant wavelength range.

46. A device as recited in claim 45, wherein the device further comprises at least two solid state light emitters.

47. A device as recited in claim 46, wherein said first electrical conductor is configured to conduct electricity to at least two solid state light emitters.

48. A device as recited in claim 47, wherein said at least two solid state light emitters comprise at least two solid state light emitters that emit light having dominant wavelength in the range of from about 600 nm to about 630 nm.

49. A device as recited in claim 46, wherein the first sensor is not sensitive to at least light in the range of from about 600 nm to about 630 nm.

50. A device as recited in claim 46, wherein the first sensor is sensitive to at least all visible light having wavelength less than about 600 nm.

51. A device as recited in claim 46, wherein said first sensor is sensitive to at least light that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

52. A device, comprising:

at least first and second electrical conductors;

at least a first circuit board;

at least a first sensor, said first sensor spaced from said first circuit board; and circuitry configured to adjust a current and/or a voltage of electricity supplied to said first electrical conductor based on an intensity of light sensed by said first sensor.

53. A device as recited in claim 52, wherein said circuitry comprises a differential amplifier circuit connected to said first sensor.

54. A device as recited in claim 52, wherein:

the device further comprises at least first and second groups of solid state light emitters, said first group of solid state light emitters comprising at least one solid state light emitter, said second group of solid state light emitters comprising at least one solid state light emitter.

55. A device as recited in claim 54, wherein:

the first group of solid state light emitters emits light of a first hue, the second group of solid state light emitters emits light of a second hue, and the first hue differs from the second hue.

56. A device as recited in claim 54, wherein said second group of solid state light emitters comprises at least one solid state light emitter which emits light having a dominant wavelength in the range of from about 600 nm to about 630 nm.

57. A device as recited in claim 54, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

58. A device as recited in claim 54, wherein said combined light comprises at least a portion of light emitted by a first group of solid state light emitters and at least a portion of light emitted by a second group of solid state light emitters, and said portion of said combined light comprises light emitted by said first group of solid state light emitters.

59. A device as recited in claim 58, wherein said portion of said combined light consists essentially of light emitted by said first group of solid state light emitters.

60. A device as recited in claim 59, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

61. A device as recited in claim 54, wherein said combined light comprises at least a portion of light emitted by a first group of solid state light emitters and at least a portion of light emitted by a second group of solid state light emitters, and said portion of said combined light comprises light emitted by said second group of solid state light emitters.

62. A device as recited in claim 61, wherein said portion of said combined light consists essentially of light emitted by said second group of solid state light emitters.

63. A device as recited in claim 61, wherein said second group of solid state light emitters comprises at least one solid state light emitter which emits light having a dominant wavelength in the range of from about 600 nm to about 630 nm.

64. A device, comprising:

circuitry configured to adjust a current and/or voltage of electrical signal supplied to at least a first solid state light emitter among first and second groups of solid state light emitters based on a signal representing an intensity of light detected by at least a first sensor, said circuitry comprising a differential amplifier circuit connected to said first sensor.

65. A device as recited in claim 64, wherein:

said device further comprises at least first and second groups of solid state light emitters and at least a first sensor, said first group of solid state light emitters comprises at least one solid state light emitter, said second group of solid state light emitters comprises at least one solid state light emitter, said first sensor is positioned such that if said first group of solid state light emitters and said second group of solid state light emitters are illuminated, said first sensor is configured to be exposed to at least a portion of light emitted by said first and second groups of solid state light emitters.

66. A device as recited in claim 64, wherein:

the first group of solid state light emitters emits light of a first hue, the second group of solid state light emitters emits light of a second hue, and the first hue differs from the second hue.

67. A device as recited in claim 64, wherein said second group of solid state light emitters comprises at least one solid state light emitter which emits light having a dominant wavelength in the range of from about 600 nm to about 630 nm.

68. A device as recited in claim 64, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

69. A device as recited in claim 64, wherein said combined light comprises at least a portion of light emitted by a first group of solid state light emitters and at least a portion of light emitted by a second group of solid state light emitters, and said portion of said combined light comprises light emitted by said first group of solid state light emitters.

70. A device as recited in claim 69, wherein said portion of said combined light consists essentially of light emitted by said first group of solid state light emitters.

71. A device as recited in claim 69, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

72. A device as recited in claim 64, wherein said combined light comprises at least a portion of light emitted by a first group of solid state light emitters and at least a portion of light emitted by a second group of solid state light emitters, and said portion of said combined light comprises light emitted by said second group of solid state light emitters.

73. A device as recited in claim 72, wherein said portion of said combined light consists essentially of light emitted by said second group of solid state light emitters.

74. A device as recited in claim 72, wherein said second group of solid state light emitters comprises at least one solid state light emitter which emits light having a dominant wavelength in the range of from about 600 nm to about 630 nm.

75. A method of lighting, comprising:

illuminating at least first and second groups of solid state light emitters, said first group of solid state light emitters including at least one solid state light emitter, said second group of solid state light emitters including at least one solid state light emitter; and adjusting a current and/or voltage of electrical signal supplied to at least one solid state light emitter among said first and second groups of solid state light emitters based on an intensity of light detected by a first sensor exposed to at least a portion of light emitted by said first and second groups of solid state light emitters, a differential amplifier circuit connected to said first sensor.

76. A device, comprising:

circuitry configured to adjust a current and/or a voltage of electricity signal supplied to at least a first solid state light emitter of a second group of solid state emitters based on a signal representing an intensity of a portion of combined light comprising at least a portion of light emitted by a first group of solid state light emitters and at least a portion of light emitted by a second group of solid state light emitters.

77. A device as recited in claim 76, wherein the circuitry is configured to adjust current and/or a voltage of electricity signal supplied to at least a first solid state light emitter of a second group of solid state emitters based on a signal representing an intensity of only light emitted from the first group of solid state light emitters.

78. A device as recited in claim 76, wherein:

the device further comprises at least first and second groups of solid state light emitters, said first group of solid state light emitters comprising at least one solid state light emitter, said second group of solid state light emitters comprising at least one solid state light emitter, the device further comprises at least a first sensor positioned such that when a first group of solid state light emitters comprising at least a second solid state light emitter and said second group of solid state light emitters are illuminated, said first sensor is exposed to combined light comprising at least a portion of light emitted by a first group of solid state light emitters and at least a portion of light emitted by a second group of solid state light emitters, the device further comprises at least first and second electrical conductors configured to apply signals for at least said first and second groups of solid state light emitters; and said circuitry is configured to adjust a current and/or a voltage of electricity signal supplied to at least said first electrical conductor for application to at least said first of said second group of solid state emitters.

79. A device as recited in claim 78, wherein:

the first group of solid state light emitters emits light of a first hue, the second group of solid state light emitters emits light of a second hue, and the first hue differs from the second hue.

80. A device as recited in claim 78, wherein the first sensor is sensitive to only a portion of said combined light.

81. A device as recited in claim 78, wherein said second group of solid state light emitters comprises at least one solid state light emitter which emits light having a dominant wavelength in the range of from about 600 nm to about 630 nm.

82. A device as recited in claim 78, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

83. A device as recited in claim 78, wherein the first sensor is sensitive to only at least a portion of light emitted by said first group of solid state light emitters.

84. A device as recited in claims 83, wherein said second group of solid state light emitters comprises at least one solid state light emitter which emits light having a dominant wavelength in the range of from about 600 nm to about 630 nm.

85. A device as recited in claim 78, wherein the first sensor is sensitive to only at least a portion of light emitted by said second group of solid state light emitters.

86. A device as recited in claim 85, wherein said first group of solid state light emitters emits light of a hue that has color coordinates on a 1931 CIE Chromaticity Diagram which define a point within an area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

87. A device as recited in claim 78, wherein the circuitry is configured to adjust current and/or a voltage of electricity signal supplied to at least a first solid state light emitter of a second group of solid state emitters based on a signal representing an intensity of only light emitted from the first group of solid state light emitters.

88. A device as recited in claim 78, wherein said combined light has x, y coordinates on a 1931 CIE Chromaticity Diagram which define a point which is within ten MacAdam ellipses of at least one point on the blackbody locus on a 1931 CIE Chromaticity Diagram.

89. A device as recited in claim 78, wherein said device further comprises at least a first circuit board, at least one solid state light emitter of said first and second groups of solid state light emitters on said first circuit board, said first sensor spaced from said circuit board.

90. A device as recited in claim 78, wherein said circuitry further comprises a differential amplifier circuit connected to said first sensor.

91. A device as recited in claim 78, wherein said circuitry is further configured to adjust a current and/or a voltage of electricity signal supplied only to said second group of solid state light emitters based on ambient temperature.

92. A method, comprising:

adjusting a current and/or a voltage of electricity signal for supplying to at least a first solid state light emitter of a second group of solid state emitters, based on a signal that represents an intensity of a portion of combined light comprising at least a portion of light emitted by a first group of solid state light emitters and at least a portion of light emitted by a second group of solid state light emitters.

* * * * *